US005168688A

United States Patent [19]

Neuhold

[11] Patent Number: 5,168,688

[45] Date of Patent: Dec. 8, 1992

[54] MOUNTING DEVICE FOR INSERTING SLIDES IN SLIDE MOUNTS

[75] Inventor: Arnold Neuhold, Farchant, Fed. Rep. of Germany

[73] Assignee: L+N-Plast Kunststoffverarbeitung GmbH & Co., Untereglfing, Fed. Rep. of Germany

[21] Appl. No.: 762,209

[22] Filed: Sep. 19, 1991

[30] Foreign Application Priority Data

Sep. 19, 1990 [DE] Fed. Rep. of Germany ..... 4029699

[51] Int. Cl.[5] ..... B65B 25/14; B65B 39/12; B65B 63/00

[52] U.S. Cl. ..... 53/520; 53/284.2

[58] Field of Search ..... 53/520, 284.2, 435, 53/389.3

[56] References Cited

U.S. PATENT DOCUMENTS 3,788,031 1/1974 Florjancic ..... 53/520
4,004,340 1/1977 Urban ..... 53/284.2 X
4,102,029 7/1978 Thompson ..... 53/520 X
4,237,678 12/1980 Thompson ..... 53/284.2 X
4,528,795 7/1985 Stemmer et al. ..... 53/284.2
4,543,771 10/1985 Jensen et al. ..... 53/520
4,934,128 6/1990 Savio et al. ..... 53/520

*Primary Examiner*—Horace M. Culver
*Attorney, Agent, or Firm*—Sughrue, Mion, Zinn Macpeak & Seas

[57] ABSTRACT

In a mounting device for the automatic insertion of a slide into slide mounts comprising a drive (1), a separating apparatus (3) and a pushing apparatus (4), film material is separated in a plane (A) which is arranged perpendicularly to the direction (B') in which the cut photographic film transparency (5) is inserted into a mount (6). A feeding plane (C) is displaced with respect to a mounting plane (B) in which the mounted transparency is located. A pushing apparatus (4) is provided in the displacement region to push the cut transparency (5) into the opened slide mount. A holding down device (20) is coupled to the separating apparatus (3) to hold down the cut transparency (5) during insertion.

10 Claims, 1 Drawing Sheet

A
A'
II
11
3
20
C
12
17
18
25
5
6
8
16
15
10
2
C
C'
B
B'
4
14
7
1
20
22'
12
14
5
21
22

MOUNTING DEVICE FOR INSERTING SLIDES IN SLIDE MOUNTS

BACKGROUND OF THE INVENTION

The present invention relates to a mounting device for the automatic insertion of slides into slide mounts or frames, comprising a drive for transporting uncut film material, a separating apparatus for separating the film material into individual photographic film transparencies, a mount feeding apparatus and a pushing apparatus for pushing each separated transparency into the slide mount, the plane in which the film material is cut being arranged perpendicularly to the direction in which the cut transparency is inserted into the mount.

In mounting devices of the type described above, several possibilities are available for inserting the transparency into the mount. Thus, a device for inserting transparencies into mounts is described in DE-AS-12 85 765 in which a movable gripping tool grips the separated transparency from behind through the mount window, the transparency being partially inserted into the mount, and with a subsequent pulling action moves the transparency into the final position. The feeding plane for the transparency is displaced with respect to the plane in which the mount into which the slide is to be inserted is located, as the mount is opened on one side and the transparency is inserted at an angle from above into the mount.

A mounting device is also known from DE-PS 19 18 970 in which the transparency is gripped at its edge by a gripping device before cutting. The gripping device consists of arcuate pincer arms which can be pivoted by means of a lever device. The gripped and cut transparency can be inserted from above into the partially open slide mount through this pivoting motion. Here, the feeding plane for the transparency is displaced relative to the mounting plane.

Finally, it is known from DE-OS 22 12 624 to transport the cut transparency into the final position in the mount by means of a pushing device. A pivotable transparency feeding path as well as a horizontally displaceable pushing tool are provided for this which carry out the transport of the transparency by appropriately synchronized pivoting and pushing movements.

SUMMARY OF THE INVENTION

It is an object of the present invention to provide a mounting device for the insertion of transparencies into slide mounts which with simple constructive means enables a quick and reliable insertion of the transparencies into the mount.

This object is solved in accordance with the invention in that a feeding plane for the uncut film material is displaced relative to a mounting plane in which the transparency is located directly after mounting, such that a displacement region is formed between the feeding plane and the mounting plane, and in that the pushing apparatus has a pusher, the pushing motion path at least partially lying in the displacement region which is located beneath the uncut film material.

By means of the apparatus according to the invention, the feeding and pushing of the transparency into the final position ensues in a single stage, as the pushing apparatus is not obstructed by the film transport on account of the plane displacement. Furthermore, the transparency is not damaged on its surface due to the application of a pusher, whereas this is possible with gripping devices on account of a relative movment between the transparency and the gripper. Additionally, due to the arrangement of the inventive apparatus, it is possible to illuminate the transparency located in the mount in order to control the position thereof, as no apparatus are located above or beneath the transparency.

In accordance with a further embodiment of the invention, the separated transparency can be inserted into the mount at the front side thereof so that a further acceleration of the mounting procedure can be achieved, as all devices for opening and closing the slide mount are dispensed with.

A positive effect on the rate of operation results if the transparency is at least partially inserted into the mount during separation. The forward movement of the film material which takes place in any case is utilized here for partial insertion so that the stroke of the subsequent pushing movement of the pushing device does not have to be so long.

In a preferred embodiment, the pusher has in its forward region in the pushing direction a substantially V-shaped recess which engages with the front side of the separated transparency when pushing. A reliable feed of the transparency is therefore guaranteed whilst simultaneously preventing a folding over of the front side. It has been shown to be particularly advantageous in this case to lengthen one arm of the V-shaped recess in the pushing direction so that a flat supporting surface is provided for the rearward edge region of the separated transparency. According to further embodiments of the invention, the pushing motion path extends linearly and also lies in the mounting plane. On account of this, simple structural means result in a particularly compact and space saving arrangement, while the insertion of slides into the mounts can simultaneously ensue particularly quickly.

In order to ensure a reliable insertion of the transparency into the mount, the bending forces acting on the film material during the inserting pushing movement must be compensated. This can ensue in accordance with a further embodiment of the invention by means of a holding down device which is provided for the rearward edge region of the transparency. This holding down device can also be coupled with the separating apparatus so that the transparency is pushed onto the flat supporting surface of the pusher after being separated. In the case that the separating apparatus is provided with a knife, the transparency can be pushed under the cutting edge of the knife by means of the holding down device so that the transparency can be reliably engaged at its front side by the pusher so that damage to the film material during the pushing movement is excluded.

In order to also ensure a reliable holding-down during the pushing movement, the holding down device can have a recess in accordance with a further embodiment at the location where it acts on the transparency, the recess lying in the pushing motion path in the actuating state of the holding down device and being adapted to the width of the pusher so that the transparency is only held down in its rearward edge region at two outer-lying regions which lie perpendicular to the pushing direction so that the pusher can push the transparency into the mount through the recess. A secure and reliable movement of the film material between the feeding plane and the mounting plane can also be achieved in that a guiding element is provided through which the film material is fed or partially inserted over an arcuate path between the revealed planes.

In order to simplify the application of so-called opening mounts, an opening device can be provided which opens the respective slide mount into which the slide is to be inserted at its front side. The processing time is similarly shortened if the slide mount is conveyed out of a magazine into the inserting position, which in accordance with a further embodiment, can ensue perpendicularly to the pushing direction of the pusher as seen from above.

BRIEF DESCRIPTION OF THE DRAWINGS

An exemplified embodiment of the invention is described in more detail below by means of the drawings in which.

DETAILED DESCRIPTION OF THE INVENTION

Figures 1, 2:
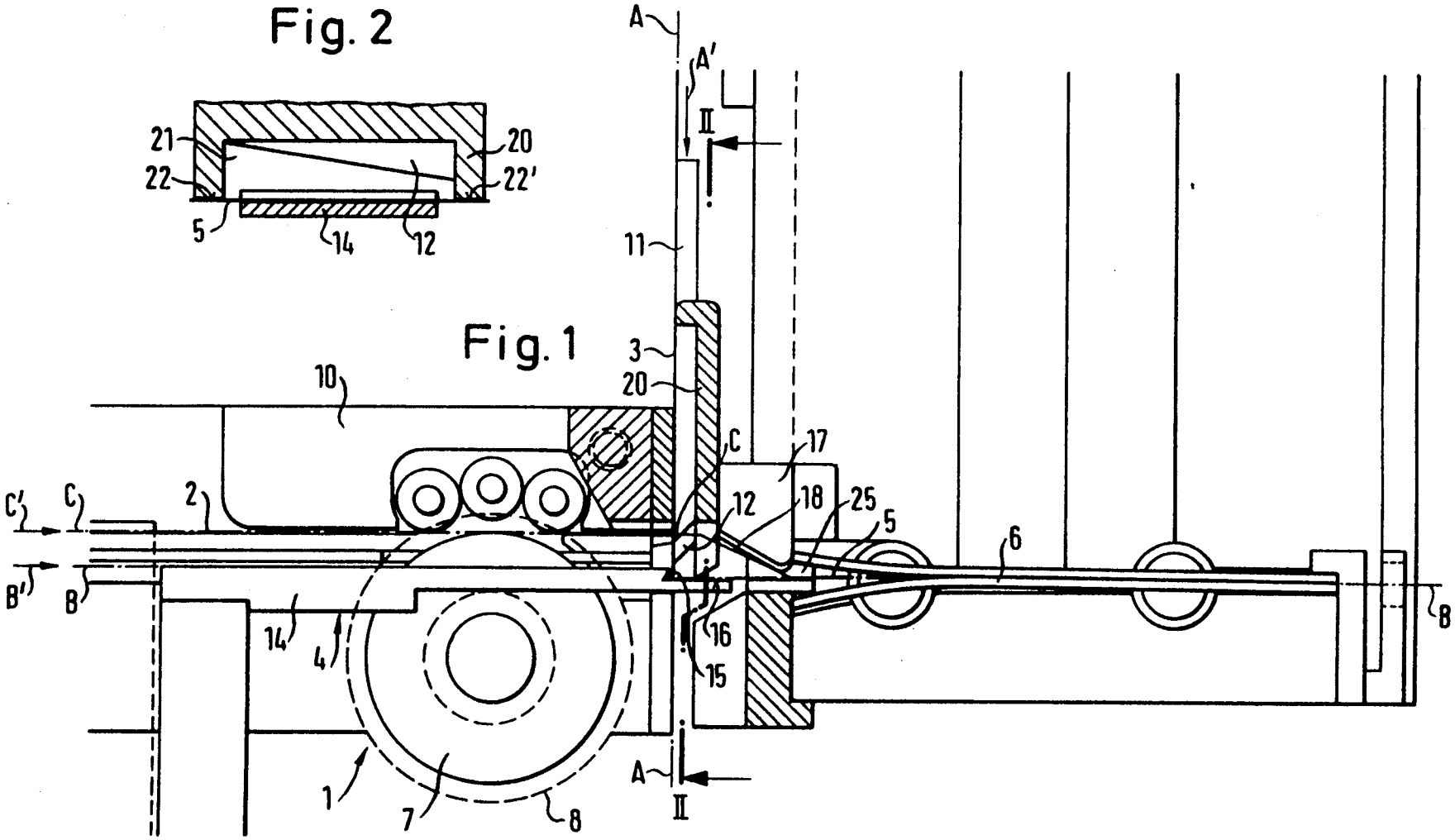
FIG. 1 shows a partially sectioned schematic side view of the mounting device according to the invention.
FIG. 2 shows a section along the line II—II of FIG. 1.

The mounting device for automatically inserting slides into slide mounts partially shown in FIG. 1 has a drive 1 for transporting uncut film material 2 as well as a separating apparatus 3 for separating the film material into individual transparencies. Furthermore, a mount feeding device not shown as well as a pushing device 4 for pushing each separated transparency 5 into a slide mount 6 are provided. Here, the plane A in which the film material is separated is perpendicular to the direction B' in which the cut transparency 5 is inserted into the mount 6.

The drive of the uncut film material 2 ensues via a spiked roller 7, the axis of which is arranged parallel to and beneath the film plane. The spikes of the spiked roller 7, the outer circumference 8 of which is depicted in dotted lines, engage in the perforations of the unseparated film material so that this is transported to the right in FIG. 1 in the feeding plane C upon rotation of the spiked roller 7 in the clockwise direction. A good abuttment of the uncut film material 2 on the spiked roller 7 is achieved by a pressure applying device not described in more detail here. A device for automatically controlling the film material is also not described in more detail here.

The separating apparatus 3 for separating the film material into individual photographic film transparencies consists of a knife 11 which is moved in the direction of the arrow A' during separation or cutting. With respect to the plane of the film material, a cutting edge 12 of the knife 11 is slightly inclined in order to achieve a particularly good cut.

The pushing apparatus 4 includes a pusher 14 which has a V-shaped recess 15 in its front region as seen in the pusher direction, the lower arm of the V-shaped recess being extended in the pusher direction so that a flat supporting surface 16 for the rearward edge region of the cut transparency is provided.

A guiding element 17 is also provided by means of which the uncut film material is guided from the feeding plane C into the mounting plane B over an arcuate path shown as a continuous thin line 18.

A holding down device 20 is coupled to the knife 11 of the separating apparatus 3 so that the holding down device is moved together with the knife in the direction of the arrow A'. As can be clearly seen from the cross-section along the axis II—II (FIG. 2), a recess 21 extending perpendicularly to the pushing direction is formed in the lower region of the holding down device 20 and is suitably adapted to the width of the pusher 14. The cut transparency 5 is only held down at two outer regions 22, 22' through the recess 21 so that the pusher 14 can insert the transparency through the recess 21 into the mount 6 (compare FIG. 1) under the cutting edge 12 of the knife 11. In order to open the slide mount into which a slide is to be inserted at the front side, an opening device 25 not described in more detail here is provided. The slide mount is opened by this device at the front side which faces the pusher 14 during insertion into the inserting position so that the transparency can be pushed from the front side into the mount. For better handling, the mounts are stored in a magazine from which they are conveyed into the inserting position via a transport device not shown. For this, the magazine for slide mounts is arranged perpendicularly to the film transport direction as seen from above.

In the following, the mode of operation of the mounting device according to the invention is described.

At the beginning of the mounting procedure, a slide mount 6 is conveyed in a direction perpendicular to the drawing plane out of the magazine into the slide inserting position shown in FIG. 1. The mount 6 is opened at one front end by means of the opening device 25 so that the transparency can be inserted. The developed film material which usually consists of several strips of film connected with one another in the longitudinal direction is inserted in the direction of the arrow C' such that the spikes of the spiked roller 7 engage the perforations of the film material. On insertion of the uncut film material 2 into the mount 6, the knife 3 of the cutting device 11 and the holding down device 20 associated with this are located in a position which lies above the position shown in FIG. 1 so that the film material is transported to the right in the direction of the guiding element 17 upon rotation of the spiked roller 7 in the clockwise direction. The film material is guided over an arcuate path 18 from the feeding plane C into the mounting frame B. After the uncut film material 2 has been partially inserted into the opened slide mount 6, the separating apparatus 3 is actuated.

Following the separating step, the knife 11 as well as the holding down device 20 coupled therewith are located in the position shown in FIGS. 1 and 2. In this position the transparency 5 which has been separated in the meantime is held down by the holding down device 20 in the regions 22 and 22'. As can be seen in FIG. 2, the regions 22 and 22' respectively lie at the edges of the cut transparency 5. It is furthermore clearly discernible that the recess 21 is formed such that the pusher 14 can be pushed through the recess 21 upon actuation of the holding down device, the holding down device acting in a stabilizing manner during a part of the pushing movement (at the beginning) on the perforated edge regions of the cut transparency. Similarly, in the end position of the knife, the cutting edge 12 of the knife 11 is arranged in such a manner that the pusher 14 can be pushed beneath the cutting edge without hindrance.

In order to completely insert the cut and held down transparency 5 into the mount 6, the pusher 14 of the pushing device 4 is actuated. In this case, the pusher 14 moves in the mounting plane in the direction of the arrow B' so that the V-shaped recess 15 of the pusher 14 is pushed against the front edge of the transparency 5. At this time, an arcing or bending of the transparency is reliably prevented by the V-shaped recess 15 and the holding down effect of the holding down device 20 in the regions 22 and 22'. In the subsequent pushing movement, the pusher 14 is pushed under the lower edge of the knife 11 and between the holding down device 20 to the extent that the transparency 5 is located in the desired final position. Following this, the pusher 14 is brought back into the initial position by the pushing device 4 and the completed mount with a slide inserted therein is replaced by a new mount in which a slide must be inserted. After the knife 11 and the holding down device 20 coupled thereto are moved back into their initial positions, which can ensue as soon as no film material is located beneath the holding down device, the next slide insertion step can be initiated.

The above description of the mode of operation shows that the mounting device according to the invention enables a very quick and reliable insertion of slides into the mounts with simple constructive means. On account of the displacement of the feeding plane with respect to the mounting plane, the pushing device can be arranged beneath the fed film material in the displacement region so that insertion can take place very quickly through application of simple constructive means. The feeding plane C can not only be displaced but also inclined. Furthermore, the advantageous embodiment of the pusher 14, the knife 11 and the holding down device 20 allows for a secure guiding of the transparency to be achieved without damage to the transparency.

What is claimed is:

1. A mounting device for the automatic insertion of slides into slide mounts comprising:

drive means for transporting uncut film material along a supply path in a feeding plane, separating means for separating the film material into individual photographic film transparencies;

slide mount support means for supporting a slide mount in a mounting plane parallel to and below said feeding plane; and pushing means for pushing each separated transparency through a displacement region into a respective slide mount in said mounting plane, said separating means being movable in a plane perpendicular to said feeding plane and said pusher means being movable in said mounting plane along a pushing motion path directly below said supply path with the pushing motion path extending through said displacement region into a slide mount.

2. A mounting device according to claim 1 wherein said pusher means includes a pusher having a V-shaped recess extending transversely of said pushing motion path for engaging an edge of a separated transparency.

3. A mounting device according to claim 1 wherein said pushing motion path is linear.

4. A mounting device as set forth in claim 2, wherein said pusher is provided with a forwardly extending arm adjacent a lower portion of said V-shaped recess having a flat supporting surface for supporting a separated transparency during pushing.

5. A mounting device as set forth in claim 1, further comprising a hold down device for engaging a separated transparency adjacent said separating means.

6. A mounting device as set forth in claim 1, wherein said separating means is comprised of a knife.

7. A mounting device as set forth in claim 5, wherein said separating means is coupled with said hold down device whereby a separated transparency is pushed against said flat supporting surface of the pusher after separation.

8. A mounting device as set forth in claim 6, wherein said hold down device has a recess in a lower edge thereof through which said pusher may pass to push a transparency into a mount.

9. A mounting device as set forth in claim 1, further comprising a guiding element disposed in said displacement region for guiding film material along an arcuate path from said feeding plane into said mounting plane.

10. A mounting device as set forth in claim 1, further comprising opening means for opening a slide mount into which a separated transparency is to be inserted.

* * * * *